US005711443A

United States Patent [19]

Bennett

[11] Patent Number: 5,711,443

[45] Date of Patent: Jan. 27, 1998

[54] TAMPER-EVIDENT CONTAINER CLOSURE

[76] Inventor: Paul H. Bennett, 441 W. Allen Ave., San Dimas, Calif. 91773

[21] Appl. No.: 697,272

[22] Filed: Aug. 21, 1996

Related U.S. Application Data

[63] Continuation of Ser. No. 157,730, Nov. 24, 1993, abandoned.

[51] Int. Cl.[6] ..... B65D 41/48

[52] U.S. Cl. ..... 215/256; 215/251; 215/258; 220/255; 220/256

[58] Field of Search ..... 215/251, 252, 215/253, 254, 256, 228, 258; 220/255, 256, 257, 212, 212.5

[56] References Cited

U.S. PATENT DOCUMENTS

| | | | |
|---|---|---|---|
| 2,326,480 | 8/1943 | Merolle | 215/256 |
| 2,806,620 | 9/1957 | Blanch | 215/256 X |
| 3,750,821 | 8/1973 | Sourbet et al. | 215/252 |
| 3,901,403 | 8/1975 | Menke | 215/251 |
| 4,109,816 | 8/1978 | Faulstich | 215/256 |
| 4,205,755 | 6/1980 | de Wijn | 215/252 |
| 4,595,110 | 6/1986 | Herr | 215/252 |
| 4,597,500 | 7/1986 | Stubbs | 215/256 |
| 4,863,050 | 9/1989 | Perry | 215/252 |

*Primary Examiner*—Stephen Cronin
*Attorney, Agent, or Firm*—Boniard I. Brown

[57] ABSTRACT

A tamper-evident closure for a container includes an outer tamper-evident cap engagable over an inner container sealing cap which may form part of the tamper-evident closure or part of the container, cap retaining prongs on the outer cap which permit placement of the outer cap on the container neck over the sealing cap but prevent upward removal of the outer cap from the container, a tear strip for severing the outer cap between its upper and lower ends to permit upward removal of the upper portion of the outer cap from the container, and a circumferential rupture line along which the outer cap separates to evidence tampering if an attempt is made to forcibly remove the outer cap from the container without tearing the tear strip from the outer cap.

42 Claims, 5 Drawing Sheets

TAMPER-EVIDENT CONTAINER CLOSURE

This application is a continuation of application Ser. No. 08/157,730 filed on Nov. 24, 1993 now abandoned.

FIELD OF THE INVENTION

This invention relates generally to closures for containers and more particularly to an improved tamper-evident container closure.

DISCUSSION OF THE PRIOR ART

Containers of the kind with which this invention is concerned are used to contain a wide variety of products including both liquids and solids. These products may be divided into two broad categories which are (a) products for human consumption or application to the human body, such as medicinal and non-medicinal liquids, solids, lotions, pills, capsules and the like, and (b) other products, such as household products and the like. This invention is particularly concerned with containers for category (a) products and will be described in the context of such containers. It will become readily evident as the description proceeds, however, that the closure may also be used on containers for category (b) products. While such containers vary widely in shape and size, they are all characterized by a container body having a normally upper portion or end containing an opening through which the container contents are accessed, and a closure in the form of a container sealing cap or the like to be secured to the upper portion or end of the container body for closing the opening. For convenience, this upper end portion of the container to which the container sealing cap is secured is referred to as the neck of the container regardless of the container shape.

A relatively few years ago, containers of the character described were commonly closed by simple caps threaded or otherwise secured to the container necks. Over the years, tampering with such containers, particularly containers for the category (a) mentioned above, has become an ever increasing problem and danger. In many cases, tampering has involved the introduction of lethal substances into the containers which resulted in the deaths of persons who later consumed some of the container contents. For this reason, an ever increasing number of product containers of the kind described, particularly containers for category (a) products, are being made tamper-evident. In this context, tamper-evident means that it is readily evident from the appearance of the container closure whether or not the container has been previously opened.

A wide variety of ways have been devised to render containers tamper-evident. Following are some of these ways: enclosing a container in an outer tamper-evident package which cannot be opened without altering it in a manner which clearly indicates the package has been opened; evacuating and sealing a container in such a way that absence of the sound of air entering the container or some other sound resulting from the loss of container vacuum when the container is opened indicates the container has been previously opened; sealing a container with a tamper-evident closure which is torn, ruptured, or otherwise altered when opened.

SUMMARY OF THE INVENTION

This invention provides an improved tamper-evident closure for containers including an upper neck having an open normally upper end, and a circumferential shoulder about the neck below its upper end. This tamper-evident closure comprises a container sealing cap for closing the open upper end of the container and a tamper-evident cap positioned about the container sealing cap. Each cap has upper and lower ends, and the tamper-evident cap has a circumferential parting region between its upper and lower ends along which the tamper-evident cap may be parted into upper and lower cap portions above and below the parting region. The container sealing cap and the tamper-evident cap are releasably connected to one another by connecting means which resist relative rotation of the caps prior to parting of the tamper-evident cap at its parting region and permit removal of the upper portion of the tamper-evident cap from the container sealing cap after parting of the tamper-evident cap at its parting region. One cap has inwardly projecting closure retaining means engagable with the under side of the container shoulder to prevent upward removal of the tamper-evident closure from the container. The preferred closure retaining means are inwardly projecting resilient prongs which are deflected upwardly by the container shoulder during placement of the closure on the container and then spring inwardly under the shoulder to prevent upward removal of the closure from the container.

The upper and lower portions of the tamper-evident cap are joined along its circumferential parting region by junction means to which a force may be applied to part the cap along the parting region, Parting of the cap along this parting region permits removal of the upper cap portion from the container by a legitimate user to access the container contents and provides an indication to a prospective buyer or legitimate user that the container has been previously opened, In the preferred embodiments of the invention described herein, this junction means comprises a tear strip which may be pulled to sever the cap along the parting region.

In one presently preferred embodiment of the invention described herein the tamper-evident cap is designed to placed over the neck of a container having its own sealing cap. This tamper-evident cap is assembled on such a container by simply pushing the cap downwardly over the container neck and its sealing cap. Other preferred embodiments of the present tamper-evident closure described herein are designed for placement on containers which do not have their own sealing, caps and include both a tamper-evident cap and a container sealing cap.

The preferred tamper-evident caps described herein have a frangible rupture line along the circumferential parting region of the cap which is stressed when any attempt is made to remove the closure from the container in any other way than by exerting a proper cap parting force on the junction means of the cap. For example, any attempt to unscrew the tamper-evident cap from the container will stress the cap along the rupture line, and this stress will cause the cap to rupture along the rupture line to indicate to a prospective purchaser or legitimate user that the container has been previously opened.

A tamper-evident closure of the invention may be used on containers intended to be sealed by various types of sealing caps. For example, certain tamper-evident closures of the invention described herein are intended for use on containers which are normally closed by simple threaded sealing caps. Other described tamper-evident closures of the invention are intended for use on containers in the form of squeeze bottles which are normally closed by liquid dispensing caps.

DESCRIPTION OF THE PREFERRED EMBODIMENTS

Figure 1:
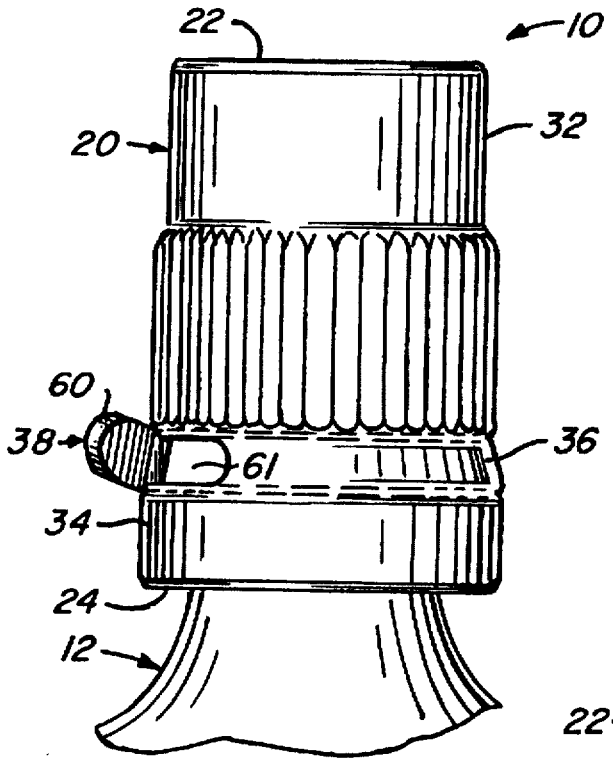
FIG. 1 illustrates a tamper-evident closure according to the invention assembled on a container.
Figure 2:
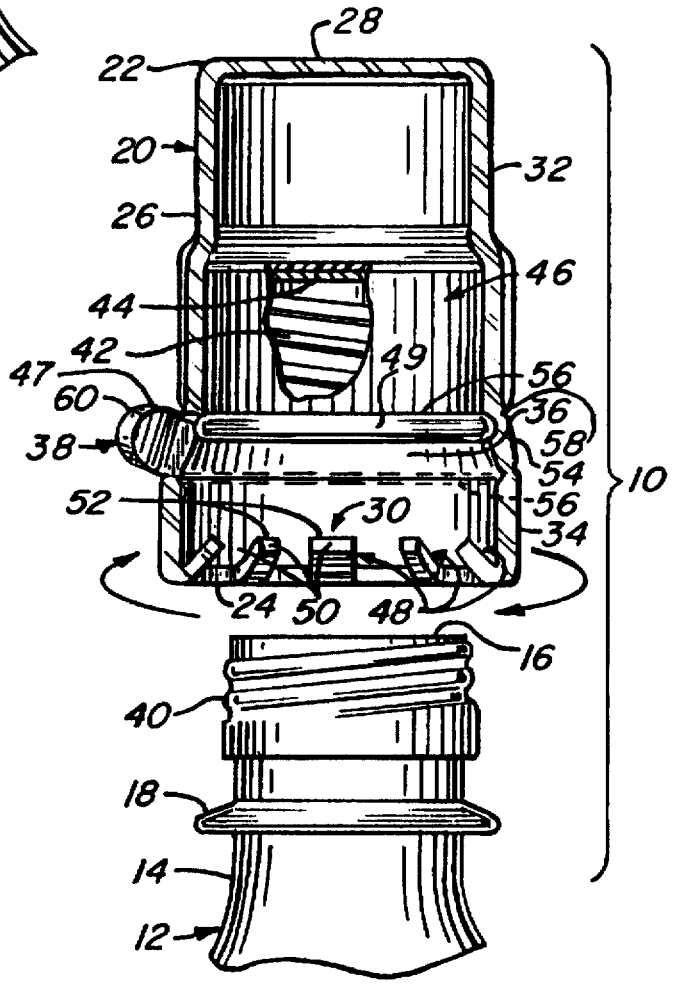
FIG. 2 illustrates the tamper-evident closure and container in FIG. 1 in disassembled relation and shows the closure in axial cross-section.

Referring now to these drawings and first to FIGS. 1 and 2, there is illustrated a tamper-evident closure 10 according to the invention for a container 12. The container has a normally upper neck 14 with an open normally upper end 16. Extending about the neck a distance below its upper end is a circumferential shoulder 18. The particular tamper-evident closure 10 illustrated is a dual purpose tamper-evident closure which both seals the open upper end 16 of the container neck 14 and provides tamper-evident protection, that is a tampering indicator, for the container. In this regard, it was noted earlier that in the context of the present invention, "tamper-evident" means that the closure serves as a tampering indicator which provides a clear indication to a purchaser or user whether or not the container has been previously opened.

The tamper-evident closure 10 comprises a tamper-evident cap 20 having normally upper and lower ends 22 and 24, a generally cylindrical side wall 26, and an upper end wall 28 joined to the upper end of the side wall and closing the upper end of the cap. The lower end of the cap is open. Joined to the lower end of the cap side wall 26, about the lower end opening in the cap, are cap retaining means 30 which engage the lower side of the container shoulder 18 to prevent upward removal of the tamper-evident cap 20 from the container neck 14.

The tamper-evident cap 20 includes upper and lower cap portions 32, 34, a parting region 36 extending circumferentially about the cap side wall 26 between these upper and lower cap portions at which the cap may be parted to separate the upper cap portion 32 from the lower cap portion 34, and junction means 38 joining the cap portions along the parting region. A force may be applied to this junction means to part the cap side wall 26 along the parting region 36 in a manner which serves the twofold purpose of indicating the container has been opened and permitting upward removal of the upper cap portion 32 from the container neck to enable a legitimate user to access the container contents.

The tamper-evident container closure 10 illustrated in FIGS. 1 and 2 is a dual purpose closure which is designed for use on a container 12 that lacks its own sealing cap or other sealing means for sealing the open upper end of the container neck 14 but does have external screw threads 40 at the upper end of the neck. This dual purpose closure 10 includes internal screw threads 42 for engaging the container screw threads 40 and sealing means 44 for sealing the open upper end of the container neck 14. The tamper-evident closure 10 is assembled on the container 12 by placing the closure over the container neck 14 and rotating the tamper-evident cap 20 of the closure in a direction to screw the closure onto the container to a position wherein the closure is tightly secured to the neck and the sealing means 44 presses firmly against the upper end of the neck about the opening in the neck to seal the opening. During this assembly of the closure 10 on the container, the retaining means 30 pass freely over the container shoulder 18 in the downward direction to a position in which the retaining means engages the underside of the shoulder to prevent upward removal of the closure from the container. The container can be opened only by exerting an appropriate force on the junction means 38 to part the upper cap portion 32 of the closure from the lower cap portion 34 of the closure. The upper portion of the tamper evident closure 10 (i.e. the upper portion 32 of the closure cap 20 and the sealing means 44 within the cap) is then removable from the container by rotating the upper cap portion 32 in a direction to unscrew the upper closure portion from the container neck to access the contents of the container through the open upper end of the container neck 14.

Referring now in more detail to FIGS. 1 and 2, the illustrated dual purpose tamper-evident closure 10 is a cap assembly including the tamper-evident cap 20, which constitutes an over cap or outer cap of the cap assembly, and an inner container sealing cap 46. The inner cap 46 and the outer cap 20 are connected by separable connecting means in such a way that the inner cap is rotatable with the outer cap prior to parting of the outer cap at its parting region 36, and the upper portion 32 of the outer cap is removable upwardly from the inner cap after parting of the outer cap at its parting region 36. For example, this separable connecting means may comprise inter engaging serrations on the inner surface of the upper portion 32 of the outer cap 20 and the outer surface of the inner cap 46, as described in connection with FIGS. 8 and 9, which serrations permit axial separation of the caps. In the particular closure embodiment illustrated, the inner cap 46 is assumed to have a sufficiently snug fit within the outer cap 20 to firmly fix the inner cap in the outer cap and restrain the caps against relative rotation. The outer cap 20 has a downwardly facing internal circumferential shoulder 47 along the upper edge of the circumferential parting region 36 engagable by an external circumferential bead or shoulder 49 about the lower end of the inner cap 46 to limit axial insertion of the inner cap into the outer cap 20. The container sealing means 44 of the tamper-evident closure 10 comprises a sealing pad within the upper end of the inner cap 46. The internal screw threads 42 of the closure 10 are on the inner surface of the inner cap. The outer cap may have external serrations to facilitate gripping and rotating the cap.

The cap retaining means 30 on the outer tamper-evident cap 20 comprises a plurality of upwardly angled, resiliently flexible prongs 48 circumferentially spaced about the inner side of and integrally joined to the lower end of the outer cap side wall 26. These prongs extend inwardly toward the longitudinal axis of the outer cap and upwardly toward the upper end of the outer cap at an oblique angle to the cap side wall 26. As shown in FIG. 2, the prongs 48 have inner end surfaces 50 which generally parallel the longitudinal axis of the outer cap 20 and intersect the upper surfaces of the prongs along relatively sharp edges 52 which are normally disposed substantially in a common plane transverse to the cap axis. As explained below, during assembly of the tamper-evident closure or cap assembly 10 on the container 12, the cap retaining prongs 48 flex upwardly and outwardly toward the outer cap wall 26 to permit the prongs to pass over the container shoulder 18. The prongs then spring inwardly below the shoulder to prevent upward removal of the cap assembly from the container.

The junction means 38 of the tamper-evident cap assembly 10 is a tear strip comprising a circumferential portion 54 of the outer cap side wall 26 between the upper an lower outer cap portions 32, 34. This portion 54 of the outer cap side wall 26 is joined to the upper and lower cap portions 32, 34 along circumferential frangible rupture or tear lines 56 formed by circumferential grooves 58 in the side wall 26 and slits in the side wall spaced along the grooves. Integrally joined to one end of the tear strip 38 is a pull tab 60 overlying an opening 61 in the cap side wall 26 which permits grasping of the pull tab. The tear strip 38 may be pulled by grasping and pulling on the pull tab 60 to sever the outer cap side wall 26 along the tear lines 56. Severing the outer tamper-evident cap 20 in this way parts the cap along the parting region 36 in a manner which serves the twofold purpose of indicating the container has been opened and separating the upper cap portion 32 from the lower cap portion 34 to permit upward removal of the upper cap portion from the container 12.

The tamper-evident closure 10 is used in this way. The closure 10 is assembled on the container 12 by placing the closure axially downward over the upper end of the container neck 14 to an initial position in which the threads 44 on the inner cap 46 engage the threads 40 on the container. The outer cap 20 is then rotated to rotate the inner cap 46 relative to the container in a direction to screw the inner cap, and thereby the entire closure, onto the container. The closure is finally tightened to firmly press the inner cap seal 44 against the upper end 16 of the container neck 14 and thereby seal the container. During this assembly of the closure 10 on the container 12, the retaining prongs 48 on the outer tamper-evident cap 20 engage the container shoulder 18 and are deflected upwardly and outwardly by the shoulder to permit the prongs to pass over the shoulder. The prongs then spring inwardly below the shoulder to prevent upward movement of the cap assembly from the shoulder.

The container 12 can be easily opened by a buyer or user by grasping and pulling on the pull tab 60 to tear the tear strip 38 from the outer tamper-evident cap 20. The upper portion 32 of the outer cap 20 is thereby parted from the lower cap portion 34 to permit removal of the upper cap portion and the inner cap 46 from the container. Removal of the upper portion 32 of the outer tamper-evident cap 20 and the inner cap 46 from the container is accomplished by rotating the upper portion 32 of the outer cap in a direction to unscrew the inner cap 46 from the container. The container may be reclosed by replacing the inner cap 46 on the container after removing the inner cap from the outer cap portion 32.

Obviously, any attempt to tamper with the container 12 by opening the container in the manner explained above would be immediately evident to a prospective purchaser or user. The container cannot, however, be opened in any other way for tampering purposes without the closure clearly evidencing such tampering. In this regard, the frangible rupture or tear lines 56 of the outer tamper-evident cap 20 are designed to rupture or tear if the a person seeking to tamper with the container attempts to open the contained by simply unscrewing the closure 10 from the container. Thus, rotation of the closure in a direction to unscrew the inner sealing cap 46 from the container urges the inner cap shoulder 49 upwardly against the outer cap shoulder 47 and thereby urges the outer cap retaining prongs 48 upwardly against the lower side of the container shoulder 18. As a consequence, this rotation of the closure 10 urges the upper portion 32 of the outer cap 20 and inner cap 46 upwardly relative to both the container and the lower portion 34 of the outer cap and thereby stresses the outer cap along the frangible tear or rupture lines 56 of the outer cap. The outer cap is designed to rupture along one or both of theses lines under this stress to indicate container tampering. As explained later in connection with FIG. 7, this feature of the tamper-evident closure also permits the closure to be opened by a purchaser or legitimate user by either rotating the outer cap of the closure in a direction to unscrew the inner sealing cap from the container or by pulling the closure tear strip.

It is evident from the foregoing description that if the inner sealing cap of the tamper-evident closure or cap assembly 10 of FIGS. 1 and 2 is fixed within the outer tamper-evident cap 20, the closure is a dual purpose tamper-evident closure for use on a container 12 lacking its own sealing cap and provides both a sealing closure for sealing the container and a tampering indicator for evidencing tampering with the container. On the other hand, if the inner sealing cap 46 is separable from the outer tamper-evident cap 20 and forms part of the container 12, the tamper-evident closure 10 is a single purpose closure which provides tamper-evident protection only. In this disclosure, it is assumed that the tamper-evident closure 10 is a dual purpose closure which includes both the inner cap 46 and the outer cap 20 so that the closure both seals the container and provides a tampering indicator for the container.

Figure 3:
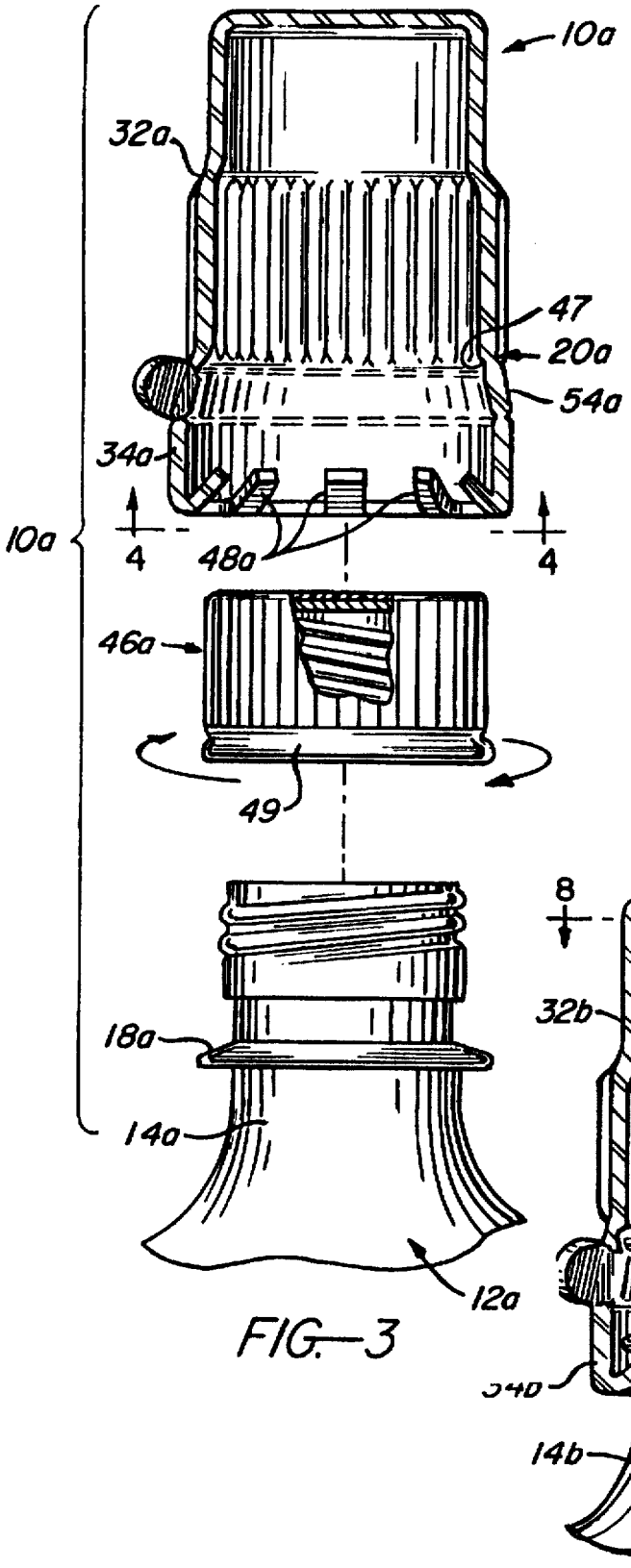
FIG. 3 is a view similar to FIG. 2 of a modified tamper-evident closure according to the invention.
Figure 4:
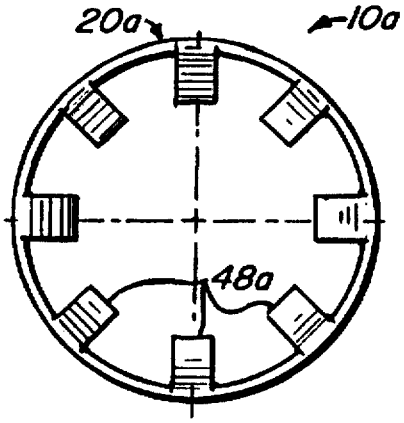
FIG. 4 is a view looking in the direction of the arrows on line 4—4 in FIG. 3.

The modified tamper-evident container closure **10*a* of FIGS. 3 and 4 is designed for use on a container 12*a* having its own sealing cap 46*a* and is essentially identical to the tamper-evident closure 10 of FIGS. 1 and 2 except that the inner sealing cap 46*a* of closure 10*a* is axially separable from the outer tamper-evident cap 20*a* and forms part of the container rather than part of the closure 10*a*. The outer cap is assembled over the inner cap in the manner described below. The inner cap 46*a* may be freely rotatable in the outer cap, or the outer and inner caps may restrained against relative rotation, as by inter-engagable inner and outer longitudinal serrations on the inner and outer caps, respectively, similar to those described in connection with FIGS. 8 and 9, which permit the outer cap to be placed over the inner cap in the manner described below and interregnal to prevent relative rotation of the caps. In the particular embodiment illustrated, the inner cap is rotatable within the outer cap. From the foregoing description, it is evident that the tamper-evident closure 10*a* comprises the tamper-evident cap 20*a*** only and is a single purpose closure which functions as a tampering indicator only.

The modified tamper-evident closure **10*a* is used in this way. The container sealing cap 46*a* will be tightly threaded on the neck 14*a* of the container 12*a* to seal the upper open end of the neck, prior to assembly of the tamper-evident cap 20*a* on the container. The cap 20*a* is assembled on the container by simply pushing the cap downwardly over both the container neck 12a and the sealing cap 46a, on the neck to a position in which the cap retaining prongs 48a engage under the container shoulder 18a. In this regard, it will be understood from the description to this point that when the tamper-evident cap 20a is pushed downwardly over the container neck, the retaining prongs 48a on the cap are deflected outwardly by the container shoulder 18a to permit the prongs to pass over the shoulder in much the same way as the prongs 48 in FIGS. 1 and 2 are deflected outwardly by the container shoulder 18 when the closure 10 is screwed onto the container neck 14. The prongs 48a then spring inwardly under the shoulder to prevent upward removal of the cap 20a from the container. The caps 20a, 46a have engageable inner and outer shoulders 47a, 49a, respectively, like the earlier described caps 20, 46**, which limit entry of the inner cap into the outer cap.

The container 12a is opened by first pulling the tear strip 38a of the tamper-evident cap 20a to part the upper cap portion 32a from the lower cap portion 34a in the same manner as explained in connection with FIGS. 1 and 2. This releases the upper cap portion 32a for upward removal of this upper cap portion from the container. Removal of the upper cap portion 32a, in turn, exposes the container sealing cap 46a for removal from the container 12a by unscrewing the sealing cap from the container. Any attempt to force the tamper-evident cap 20a upwardly from the container without pulling the tear strip 38a for the purpose of tampering with the container will result in rupture of the cap along its tear lines 56a to indicate that such tampering has occurred.

Figure 5:
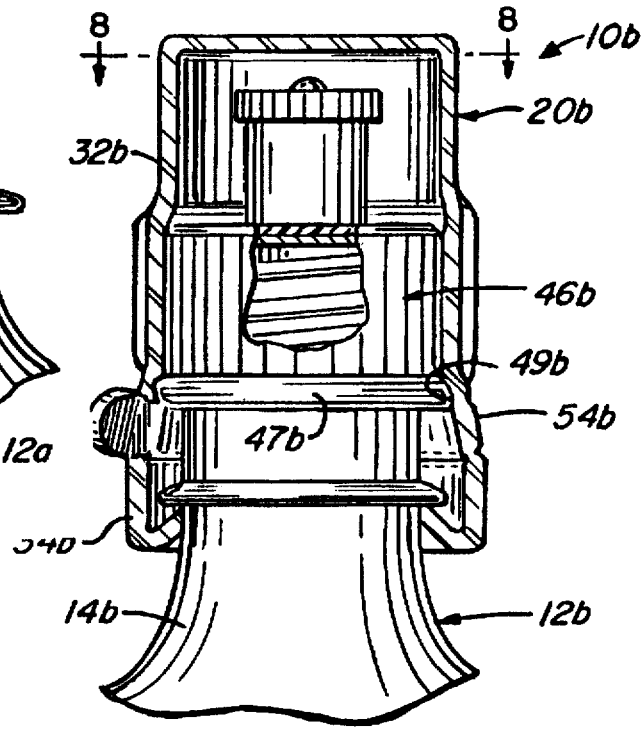
FIGS. 5 and 6 are views similar to FIG. 1 of further modified tamper-evident closures according to the invention for liquid dispensing containers and showing the caps in axial cross-section.

FIG. 5 illustrates a further modified tamper-evident container closure 10b according to the invention assembled on a container 12b. Closure 10b comprises a tamper-evident cap 20b identical to the tamper-evident caps 20, 20a of FIGS. 1–4. Container 12b is identical to the containers 12, 12a of FIGS. 1–4, except that container 12b is a squeeze bottle for containing a liquid or semi-liquid product. The upper open end of the container neck 14b is closed by a sealing cap 46b which, in this case, is a squeeze bottle dispensing cap like that described in U.S. Pat. No. 5,145,094. As described in this patent, the intended use of the dispensing cap 46b requires that this cap remain on the container and be exposed to permit adjustment of dispensing cap between its open and closed positions and dispensing of the container contents through the cap. Accordingly, the dispensing cap 46b, like the sealing cap 46a in FIGS. 3 and 4, is not permanently fixed within the tamper-evident cap 20b.

The dispensing cap 46b may be associated with the tamper-evident cap 20b in either of two different ways. According to one of these ways, the dispensing cap forms part of the container 12b and is placed on the container prior to and totally independent of placement of the tamper-evident cap 20b on the container. In this case, the tamper-evident cap 20b is internally sized to fit loosely or slidably over the dispensing cap 46b and is applied to the container 12b by pushing the tamper-evident cap downwardly over the container neck 14b and the dispensing cap 46b in the same manner as described above in connection with FIGS. 3 and 4. According to another way of associating the tamper-evident cap 20b and the container dispensing cap 46b, the dispensing cap forms part of tamper-evident closure 10b and is removably fitted within the upper portion 32b of the tamper-evident cap in such a way that the inner dispensing cap is rotatable with but axially separable from the outer tamper-evident cap, as explained in connection with FIGS. 1 and 2. Both caps may then be assembled on the container 12b simultaneously by rotating the outer cap 20b in a direction to screw the inner cap 46b onto the container neck in much the same manner as described earlier in connection with FIGS. 1 and 2. In both cases, the tamper-evident cap 20b provides a tamper indicator for the container 12b, and the upper portion 32b of the cap 20b is removed from the container 12b and its dispensing cap 46b to access the dispensing cap by first pulling the tear strip 38b to part the upper tamper-evident cap portion 32b from the lower cap portion 34b and then removing the upper cap portion upwardly from the dispensing cap.

Figure 8:
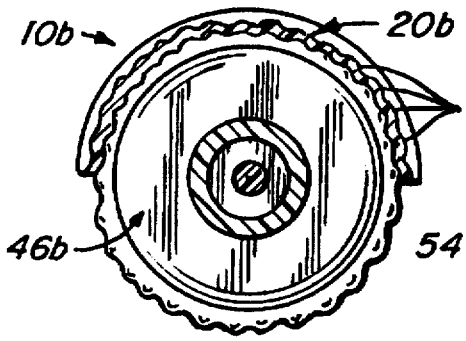
FIG. 8 is a section taken on line 8—8 in FIG. 5.

The inner dipensing cap 46b may be removably and non-rotatably engaged within the outer tamper-evident cap 20b in various ways. According to the preferred practice of the invention, this is accomplished by providing the inner dispensing cap and the upper portion 32b of the outer tamper-evident cap with longitudinal serrations 62b, as shown in FIG. 8. These serrations slidably engage one another when the outer and inner caps are assembled, either by pushing the outer cap downwardly over the inner cap when placing the outer cap on the container 12b (if the inner cap forms part of and is previously assembled on the container), or by insertion of the inner cap into the outer cap prior to placing either cap on the container (if the inner cap forms part of the closure 106). The serrations 62b effectively key the two caps against relative rotation in such a way as to (a) enable the inner dispensing cap 46b to be screwed onto the container neck 14b by rotation of the outer tamper-evident cap 20b, (b) permit entry of the dispensing cap into the tamper-evident cap prior to or during assembly of the outer cap on the container, and (c) permit upward removal of the upper tamper-evident cap portion 32b from the dispensing cap after this upper cap portion has been severed from the lower cap portion 34b by pulling the tear strip 54b of the tamper-evident cap. The caps 2Ob, 46b have engagable inner and outer shoulders 47b, 49b, respectively, like the earlier described caps 20, 46 and 20a, 46a, which limit entry of the inner cap into the outer cap.

Figure 6:
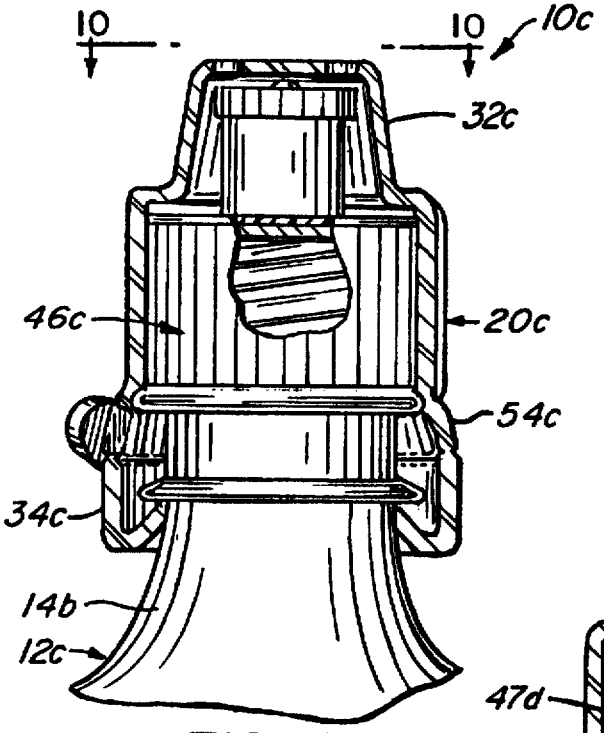
Figure 10:
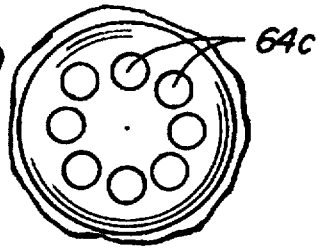
FIG. 10 is a view looking in the direction of the arrows on line 10—10 in FIG. 6.

FIGS. 6 and 10 illustrate a further modified tamper-evident closure 10c according to the invention assembled on a container 12c. Closure 10c comprises a tamper-evident cap 20c identical, except for the differences noted below, to the tamper-evident cap 20b of FIG. 5. Container 12c is a squeeze bottle identical to the squeeze bottle container 12b of FIG. 5. The upper open end of the container neck 14b is closed by a sealing and dispensing cap 46c identical to the dispensing cap 46b of FIG. 5.

The tamper-evident cap 20c and dispensing cap 46c may be associated in either of the two different ways discussed above in connection with FIG. 5. Thus, the dispensing cap 46c may form part of the container 12c and be placed on the container prior to and totally independent of placement of the tamper-evident cap 20c on the container. In this case, the tamper-evident cap 20c is pushed downwardly over the container neck 12c and the dispensing cap 46c. Alternatively, the dispensing cap 46c may be removably fitted into the upper portion 32c of the tamper-evident cap 20c in such a way that the inner dispensing cap forms part of the tamper-evident closure and is rotatable by rotation of the outer tamper-evident cap. In this latter case, both caps are .assembled on the container 12c simultaneously by rotating the outer cap 20c to screw the inner cap 46c onto the container in the same way as described above in connection with FIG. 5. The tamper-evident cap 20c thus provides a tampering indicator for the container 12c, and the upper portion 32c of the cap 20c is removed from the container 12c and its dispensing cap 46b to access the dispensing cap by first pulling the tear strip 54c to part the upper tamper-evident cap portion 32c from the lower cap portion 34c and then removing the upper cap portion upwardly from the dispensing cap.

The tamper-evident cap 20c differs from the tamper-evident cap 20b of FIG. 5 only in the following respects. The upper end of the upper cap portion 32c of cap 30c is reduced in diameter and tapered to fit more closely about the upper end of the dispensing cap 46c, as shown. Also, the upper end of the upper cap portion contains a circular TOW of holes 64c for aiding molding of the cap 20c.

Figure 7:
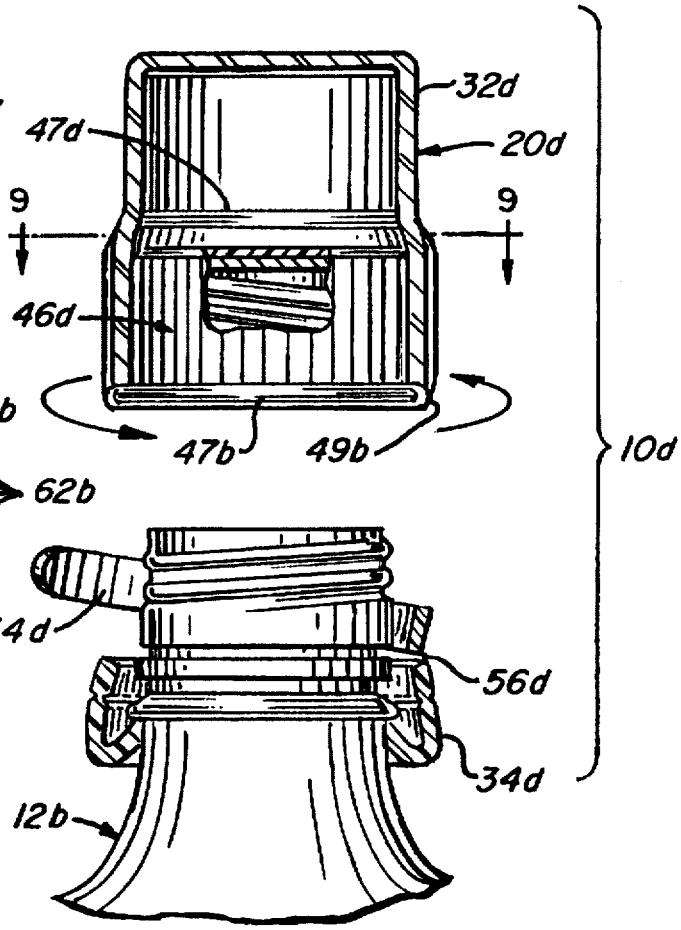
FIG. 7 illustrates the manner in which a tamper-evident closure according to the invention is parted to uncover the contents of the container on which the closure is mounted.
Figure 9:
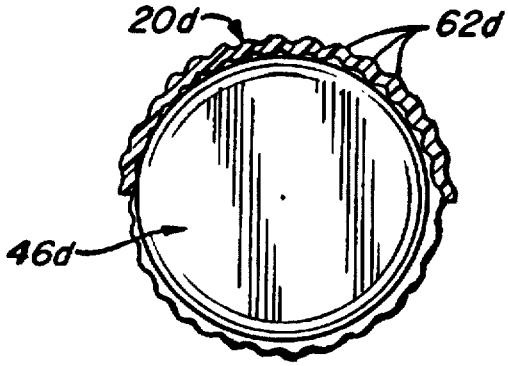
FIG. 9 is a section taken on line 9—9 in FIG. 7.

The modified tamper-evident closure 10d of FIGS. 7 and 9 can be considered to be identical to either the closure 10 of FIGS. 1 and 2 or the closure 10a of FIGS. 3 and 4 except that the outer tamper-evident cap 20d and the inner container sealing cap 46d have inter-engaging serrations 62d (FIG. 9) like those in FIG. 8 to firmly secure the caps against relative rotation. The inner sealing cap 46d may be part of the outer tamper-evident cap 20d, in which case the inner cap is fixed within the outer cap, and the two caps are simultaneously assembled on the container 12d by rotating the outer cap to screw the inner cap on the container in the same manner as described in connection with FIGS. 1 and 2. Alternatively, the inner cap 46d may be part of the container 12d, in which case the inner cap is assembled on the container prior to and independently of placement of the outer tamper-evident cap on the container, and the outer cap is assembled on the container by pushing the outer cap downwardly over the container neck and the inner cap in the same manner as described in connection with FIGS. 3 and 4. In either case, the container 12d may be opened by tearing off the closure tear strip 38d and unscrewing the sealing cap 46d from the container in the same manner as explained earlier in connection with FIGS. 1–4.

FIG. 7 illustrates an alternative way of removing the outer tamper-evident cap 20d and the inner container sealing cap 46d from the container 12d by rotating the outer cap and hence the inner cap in a direction to unscrew the inner cap from the container. In this regard, it will be understood that rotation of the caps in a direction to unscrew the inner cap from the container causes the inner cap to exert an upward thrust on the upper portion 32d of the outer cap by virtue of engagement of the outer bead or shoulder 49d on the inner cap with the inner shoulder 47d on the outer cap. The lower portion 34d of the outer cap, on the other hand, is fixed against upward movement relative to the container by engagement of the cap retaining prongs 48d with the container shoulder 18d. Accordingly, unscrewing the inner cap by rotating the outer cap in the manner described stresses the rupture lines 56d of the outer cap 20d in the axial direction of the outer cap. These rupture lines are designed to part under this stress, as illustrated in FIG. 7, to separate the upper portion 32d of the outer cap 20d from the lower portion of the latter cap and thereby permit removal of the inner sealing cap 46d from the container 12d. Any attempt to tamper with the container by removing the caps in this way will also cause parting of the outer cap to evidence such tampering.

FIGS. 11–14 illustrate the presently preferred tamper-evident container closure 10e of this invention. This preferred closure is generally similar to the earlier described tamper evident closures of the invention. Thus, the preferred closure 10e includes an outer tamper-evident cap 20e having upper and lower portions 32e, 34e, respectively, joined to one another along a circumferential parting region 36e by a circumferential junction means 38e forming a tear strip. This tear strip 38e may be pulled to sever the cap 20e along circumferential rupture or tear lines 56e and thereby separate the cap portions 32e, 34e. At the lower open end of the cap 20e are cap retaining means 30e in the form of inwardly and upwardly extending prongs 48e joined to and spaced circumferentially about the lower end of the cap.

Within the outer tamper evident cap 20e is an inner container sealing cap 46e. As in the tamper evident closures of FIGS. 1–4 and 7, the inner sealing cap 46e may be part of the outer tamper-evident cap 20e, in which case the inner cap may be separable from the upper portion 32e of the outer cap and the two caps may be simultaneously assembled on the container by rotating the outer cap to screw the inner cap on the container in the same manner as described in connection with FIGS. 1 and 2. Alternatively, the inner cap 46e may be part of the container, in which case the inner cap is separable from the outer tamper evident cap 20e and assembled on the container prior to and independently of placement of the outer cap on the container. The outer cap is then assembled on the container by pushing the outer cap downwardly over the container neck and the inner sealing cap, as described in connection with FIGS. 3 and 4.

Figure 12:
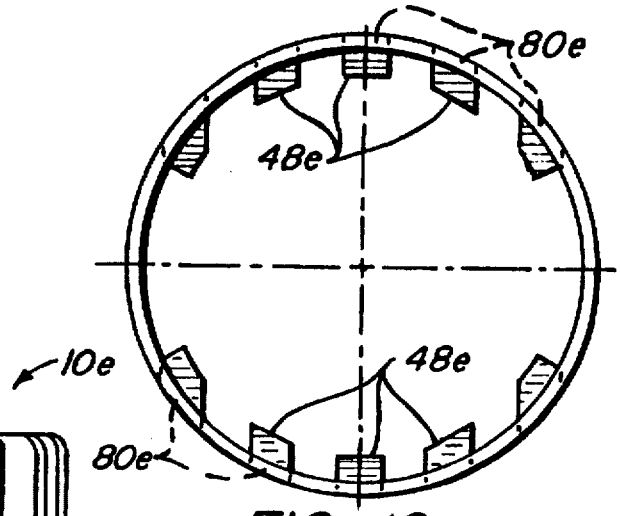
FIG. 12 is section taken on line 12—12 in FIG. 11.
Figure 11:
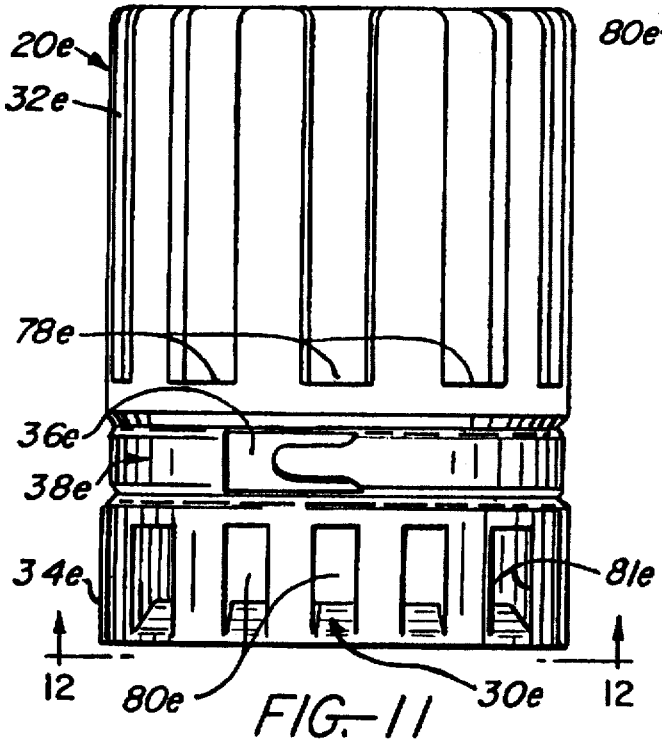
FIG. 11 is a side elevation of a presently preferred tamper-evident container closure according to the invention.
Figure 13:
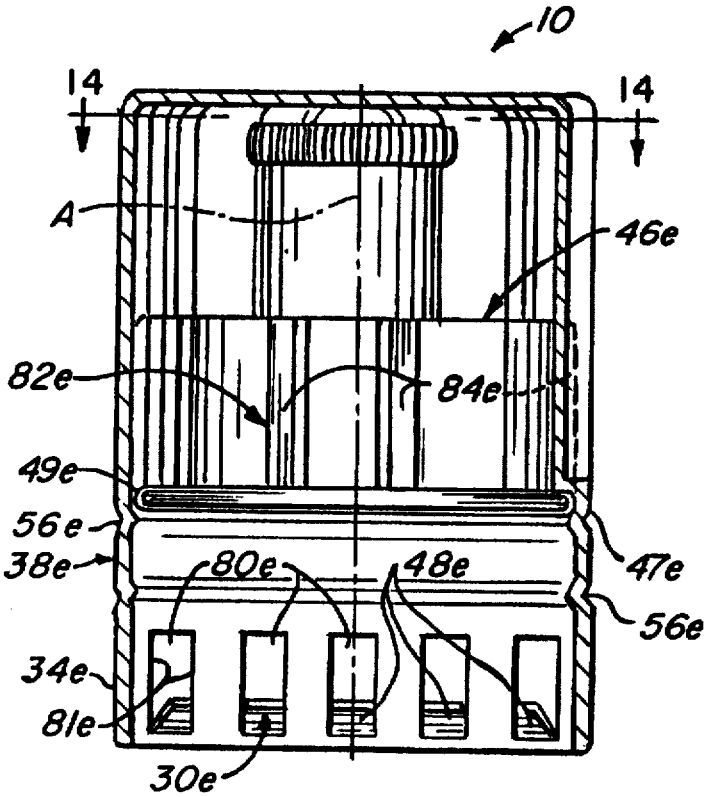
FIG. 13 is a longitudinal section through the closure in FIG. 11 taken on line 13—13 in FIG. 14.
Figure 14:
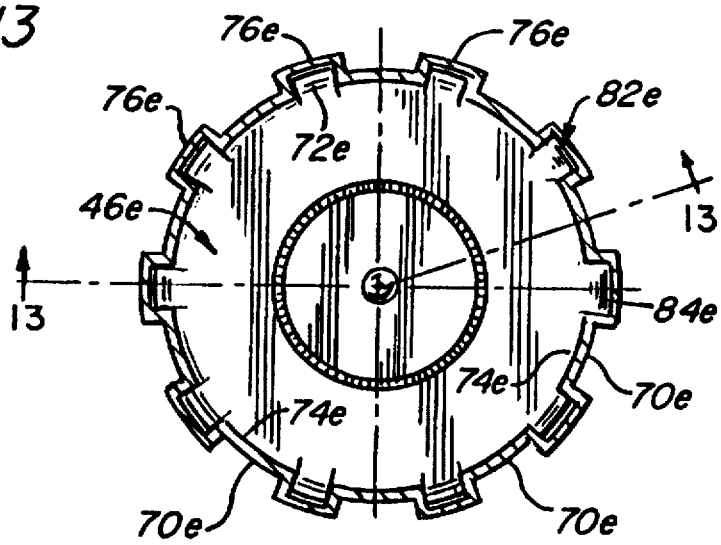
FIG. 14 is a section taken on line 14—14 in FIG. 13.

The tamper-evident cap 20e and the container sealing car 46e differ from those of FIGS. 1–4 and 7 in the following respects. Within the upper portion 32e of the tamper-evident cap 20e, the cap side wall 26e has a plurality of alternating, inner and outer longitudinal flute-like recesses or channels 70e, 72e, respectively, spaced circumferentially about the cap. These recesses, in turn, form a plurality of alternating, inner and outer longitudinal ribs 74e, 76e, respectively, spaced circumferentially about the cap. The inner surfaces of the inner ribs are cylindrically curved to a common radius about the longitudinal axis of the cap 20e. The outer surfaces of the outer ribs are also cylindrically curved to a common radius about the longitudinal axis of the cap 20e. The inner ribs 74e have lower ends 78e located in a common plane transverse to the longitudinal axis of the cap 20e and forming within the cap downwardly facing shoulders 47e (only one shown) at the lower end of the upper cap portion 32e. Within the lower portion 34e of the cap 20e are a plurality of circumferentially spaced rectangular holes 80e in the cap side wall 26e aligned with the inner cap prongs 48e, respectively. The cap is injection molded from a suitable plastic, and the holes 80e are sized and shaped to receive retractable parts (not shown) of the injection mold which cooperate with other parts (not shown) of the mold to form the prongs 48e during the molding process. As shown in FIGS. 11–13, the cap holes 80e form rectangular windows spaced circumferentially about and opening through the lower cap portion 34e. Each window 80e has parallel side edges 81e extending endwise of the cap 20e in parallel planes which are parallel to the longitudinal axis A of the outer cap 20e and transverse to the plane of the respective window. Each prong 48e is situated between the parallel planes of the side edges 81e of the respective window 80e and has an outer end joined to the side wall 26e of the lower cap portion 34e along the lower end of the respective window. Each prong 48e normally extends inwardly and upwardly from the lower end of the respective window 80e and is resiliently flexible upwardly and outwardly into the respective window. The prongs are resiliently flexible upwardly and outwardly toward their respective windows 80e, and into the windows if necessary to permit the prongs to pass over the shoulder (not shown) on the container neck (not shown) during assembly of the cap on the container in same way as explained in connection with the earlier described embodiments of the invention. Except for the differences noted above and other minor differences of shape end size, the tamper-evident cap 20e is essentially identical to and used in essentially the same way as the earlier described tamper-evident caps of FIGS. 1–4 and 7.

The container sealing cap 46e is essentially identical to the earlier described sealing caps of FIGS. 1–4 and 7 and differs from these earlier caps only in the following respects. The sealing cap 46e is cylindrically curved to an external radius approximating the common radius of curvature of the inner surfaces of the inner ribs 74e on the tamper-evident cap 20e. Note specifically, the cap 46e is externally sized to have either a relatively snug fit or a somewhat loose or sliding fit within the upper portion 32e of the cap 20e depending upon whether the cap 48e is intended to remain in the upper cap portion 32e and form part of the tamper-evident closure 10e or is intended to be separable from the cap 20e and form part of the container. Circumferentially spaced about the exterior of the sealing cap 46e are pairs 82e of longitudinal spline-like ribs 84e which extend upwardly from the external bead to shoulder 49e about the lower end of the cap. The rib pairs 82e are sized and shaped to engage within certain of the inner recesses 72e in the tamper-evident cap 20e in the manner shown in FIG. 14 when the cap 20e is assembled over the sealing cap 46e. This engagement of the rib pairs 82e in the cap recesses 72e secures the caps 20e, 46e against relative rotation, whereby the sealing cap 46e is rotatable by the tamper-evident cap. The outer sealing cap shoulder 49e is engagable with the inner tamper-evident cap shoulders 47e to limit upward movement of the sealing cap in the tamper-evident cap.

From the above description, it is evident that the tamper-evident cap 20a and the container sealing cap 46e are assembled on a container (not shown) of the type described earlier and are removable from the container in the same manner as explained in connection with FIGS. 1–4 and 7. Accordingly, no further description of FIGS. 11–14 is necessary.

Figure 15:
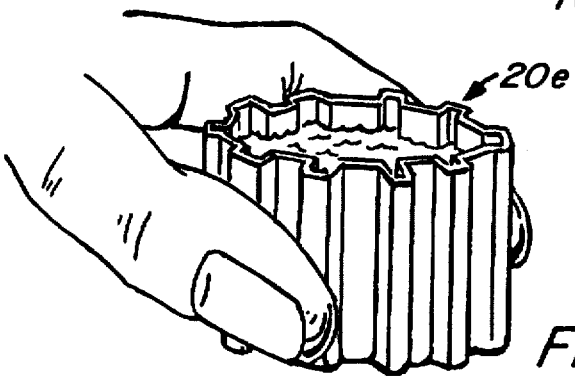
FIG. 15 is a perspective view showing the outer cap portion of the container closure of FIG. 11 grasped as a drinking vessel by the fingers of a user.

FIG. 15 illustrates an auxiliary use of the outer cap 20e of the tamper-evident container closure of FIG. 11, and shows it in use as a drinking vessel or cup being grasped by the hand of a user. Such use of the outer cap is particularly convenient for such purposes as the taking of prescription drugs or other medicaments provided in the container on which the container closure is provided.

I claim:

1. In combination:

a container including an upper neck having an open upper end, and a circumferential shoulder about said neck below said upper end having a lower side, an inner cap having internal screw threads threaded on and sealing the open upper end of said container neck, a tamper-evident closure for said container comprising a tamper-evident outer cap positioned over said neck and said inner cap and including a circumferential side wall having upper and lower ends, an upper end wall joined to the upper end of said side wall and closing the upper end of the outer cap, an opening in the lower end of said outer cap circumferentially surrounded by the lower end of said side wall, and cap retaining means at the lower end of said side wall engagable with the lower side of said shoulder to prevent upward removal of said outer cap from said container neck, and wherein said outer cap side wall includes a parting region extending circumferentially about said side wall between said ends of said side wall at which the outer cap may be parted into a lower cap portion which is fixed against upward removal from the container neck by said cap retaining means and an upper cap portion which is removable upwardly from the neck and from said inner cap, and junction means joining said cap portions along said parting region to which a force may be applied to part said cap along said region, said lower cap portion contains windows spaced circumferentially about and opening through said side wall, each window having a lower end adjacent said lower end of said side wall, said cap retaining means comprise resilient prongs joined to said side wall along the lower ends of said windows, respectively, and extending inwardly and upwardly from said side wall, and said prongs having inner ends engagable with the lower side of said container shoulder to prevent upward removal of said outer cap from said container neck and being resiliently flexible upwardly and outwardly toward the respective windows to permit downward passage of the prongs over said container shoulder during placement of said outer cap on the container neck, and said caps have releasably engagable means which enable rotation of said inner cap by rotation of said outer cap and upward removal of said upper cap portion from said inner cap after parting of said outer cap along said parting region.

2. The combination of claim 1 wherein:

said outer cap has an inner circumferential shoulder above said parting region, and said inner cap has an external circumferential shoulder engagable with said inner shoulder to limit upward movement of said inner cap within said outer cap, whereby rotation of said inner cap by rotation of said outer cap in a direction to unscrew said inner cap from the container with said cap retaining means in contact with said container shoulder urges said upper portion of said outer cap upwardly relative to said lower portion of said outer cap to part said outer cap along said parting region.

3. The combination of claim 2 wherein:

the upper portion of said tamper-evident cap is configured and adapted for use as a drinking vessel after parting of said tamper-evident cap at said parting region.

4. In combination:

a container including an upper neck having an open upper end, a circumferential shoulder about said neck below said upper end having a lower side and external screw threads between said upper end of said neck and said shoulder, an inner cap having internal screw threads threaded on and sealing the open upper end of said container neck, a tamper-evident outer cap positioned over said neck and said inner cap including a circumferential side wall having upper and lower ends, an upper end wall joined to the upper end of said side wall and closing the upper end of the outer cap, an opening in the lower end of said outer cap circumferentially surrounded by the lower end of said side wall, and cap retaining means at the lower end of said side wall engagable with the lower side of said shoulder to prevent upward removal of said outer cap from said container neck and said inner cap, and wherein said outer cap side wall includes a parting region extending circumferentially about said side wall between said side wall ends at which the outer cap may be parted into a lower cap portion which is fixed against upward removal from the container neck by said cap retaining means and an upper cap portion which is removable upwardly from the neck and said inner cap, and junction means joining said cap portions along said parting region to which a force may be applied to part said outer cap along said region, and said caps include releasably engagable means which enable rotation of said inner cap by rotation of said outer cap and removal of said upper cap portion from said container neck and said inner cap after parting of said outer cap along said parting region.

5. The combination of claim 4 wherein:

said outer cap has an inner circumferential shoulder above said parting region, said inner cap has an external circumferential shoulder below and engagable with said outer cap shoulder to limit upward movement of said inner cap within said outer cap, and rotation of said inner cap by rotation of said outer cap in a direction to unscrew said inner cap from the container with said cap retaining means in contact with said container shoulder urges said upper portion of said outer cap upwardly relative to said lower portion of said outer cap to part said outer cap along said region.

6. The combination of claim 4 wherein:

the upper portion of said tamper-evident cap is configured and adapted for use as a drinking vessel after parting of said tamper-evident cap at said parting region.

7. A tamper evident closure for a container including an upper neck having an open upper end, and a circumferential shoulder about said neck below said upper end having a lower side, said closure comprising:

an inner cap having internal screw threads, a tamper-evident outer cap positioned over said inner cap and including a circumferential side wall having upper and lower ends, an upper end wall joined to the upper end of said side wall and closing the upper end of the outer cap, an opening in the lower end of said outer cap circumferentially surrounded by the lower end of said side wall, and cap retaining means at the lower end of said side wall, and wherein said cap side wall includes a parting region extending circumferentially about said side wall between said ends of said side wall at which the outer cap may be parted into a lower cap portion and an upper cap portion, and junction means joining said cap portions along said parting region to which a force may be applied to part said outer cap along said region, said lower cap portion contains windows spaced circumferentially about and opening through said side wall, each window having a lower end adjacent said lower end of said side wall, said cap retaining means comprise resilient prongs joined to said side wall along the lower ends of said windows, respectively, and extending inwardly and upwardly from said side wall, and said prongs are resiliently flexible upwardly and outwardly toward the respective windows, and said caps have releasably engagable means which enable rotation of said inner cap by rotation of said outer cap and upward removal of said upper cap portion from said inner cap after parting of said outer cap along said parting region.

8. The closure of claim 7 wherein:

said outer cap has an inner circumferential shoulder above said parting region, and said inner cap has an external circumferential shoulder engagable with said outer cap shoulder to limit upward movement of said inner cap within said outer cap.

9. A tamper evident closure for a container including an upper neck having an open upper end, a circumferential shoulder about said neck below said upper end having a lower side and external screw threads between said upper end of said neck and said shoulder, said closure comprising:

an inner cap having internal screw threads, a tamper-evident outer cap positioned over said inner cap including a circumferential side wall having upper and lower ends, an upper end wall joined to the upper end of said side wall and closing the upper end of the outer cap, an opening in the lower end of said outer cap circumferentially surrounded by the lower end of said side wall, and resilient cap retaining means at the lower end of and projecting radially inward from said side wall, and wherein said outer cap side wall includes a parting region extending circumferentially about said side wall between said side wall ends at which the outer cap may be parted into a lower cap portion and an upper cap portion, and junction means joining said cap portions along said parting region to which a force may be applied to part said outer cap along said region, and said caps include releasably engagable means which enable rotation of said inner cap by rotation of said outer cap and removal of said upper cap portion upwardly from said inner cap after parting of said outer cap along said parting region.

10. The tamper evident closure of claim 9 wherein:

said outer cap has an inner circumferential shoulder above said parting region, and said inner cap has an external circumferential shoulder engagable with said outer cap shoulder to limit upward movement of said inner cap within said outer cap.

11. The tamper-evident closure of claim 9 wherein:

the upper portion of said tamper-evident cap is configured and adapted for use as a drinking vessel after parting of said tamper-evident cap at said parting region.

12. In combination:

a container including an upper neck having an open upper end, a circumferential shoulder about said neck having a lower side, and a tamper-evident closure on said container, and wherein said closure comprises a removable container sealing cap on and closing said open upper end of said neck, a tamper-evident cap in contact with said sealing cap and having a circumferential parting region at which said tamper-evident cap is separable into upper and lower cap portions, at least a portion of the tamper-evident cap extending above the sealing cap, closure retaining means on said tamper-evident closure and engaging said container shoulder for resisting removal of said tamper-evident closure from said container, and wherein the tamper-evident closure has means on the tamper-evident cap to cooperate with the sealing cap for resisting relative rotation between the caps upon rotation of the tamper-evident cap until the tamper-evident cap is separated at the parting region by engagement of said closure retaining means with said container shoulder to resist upward movement of the sealing cap.

13. The combination of claim 12 wherein:

said container has external screw threads about said neck above said shoulder, and said sealing cap comprises an internally threaded cap threaded on said container neck.

14. The combination of claim 12 wherein:

said closure retaining means are on said tamper-evident cap.

15. The combination of claim 12 wherein:

the upper portion of said tamper-evident cap is configured and adapted for use as a drinking vessel after parting of said tamper-evident cap at said parting region.

16. A tamper-evident closure according to claim 12, wherein:

upon rotation of said tamper-evident cap said sealing cap is rotatable with the tamper-evident cap to separate the tamper-evident cap at the parting region.

17. The combination of claim 12 wherein:

said caps have upper and lower ends, the lower end of said tamper-evident cap extends below the lower end of the sealing cap, and said closure retaining means are located at the lower end portion of said one cap.

18. The combination of claim 17 wherein:

said container neck has external screw threads above said shoulder, and said sealing cap comprises an internally threaded cap threaded on said container neck.

19. The combination according to claim 17, wherein:

said tamper-evident closure is assembled on the container by being urged downwardly over said sealing cap on the container neck and into position wherein said closure retaining means engage under said container shoulder.

20. The combination according to claim 17, wherein:

said closure retaining means comprise prongs on the tamper-evident cap which during assembly of the tamper-evident closure on a container engage said container shoulder and are deflected outwardly to permit the prongs to pass said shoulder, and then spring inwardly below the shoulder to resist removal of the tamper-evident closure from the container.

21. A tamper-evident closure for a container including an upper neck having an open upper end, a circumferential shoulder about said neck having a lower side, and a tamper-evident closure on said container, said tamper-evident closure comprising:

a removable container sealing cap to be placed on and close said open upper end of said container neck, a tamper-evident cap in contact with said sealing cap having a circumferential parting region at which said tamper-evident cap may be parted into upper and lower cap portions above and below said parting region, closure retaining means on said tamper-evident closure and engaging said container shoulder for resisting removal of said tamper-evident closure from said container, and separable connecting means on the tamper-evident cap for resisting relative rotation between the caps by twisting the tamper-evident cap and enabling parting of the tamper-evident cap at said circumferential parting region for removal of said upper portion of said tamper-evident cap from said sealing cap after said parting at said circumferential parting region.

22. The tamper-evident closure of claim 21 wherein:

said container has external screw threads about said neck above said shoulder, and said sealing cap is an internally threaded cap threadable on said container neck.

23. The tamper-evident closure of claim 21 wherein:

said closure retaining means are on said tamper-evident cap.

24. The tamper-evident closure of claim 21 wherein:

the upper portion of said tamper-evident cap is configured and adapted for use as a drinking vessel after parting of said tamper-evident cap at said parting region.

25. A tamper-evident closure according to claim 21, wherein:

upon rotation of said tamper-evident cap said sealing cap is rotatable with the tamper-evident cap to separate the tamper-evident cap at the parting region.

26. The tamper-evident closure of claim 21 wherein:

said caps have upper and lower ends, the lower end of said tamper-evident cap extends below the lower end of said sealing cap, and said closure retaining means are located at the lower end portion of said tamper-evident cap.

27. The tamper-evident closure of claim 26 wherein:

said container neck has external screw threads above said shoulder, and said sealing cap comprises an internally threaded cap threadable on said container neck.

28. The tamper-evident closure according to claim 26, wherein:

said tamper-evident closure is assembled on the container by urging the tamper-evident cap downwardly over the sealing cap on the container neck and into a position wherein said closure retaining means on the tamper-evident closure engage said container shoulder to resist removal of the tamper-evident closure.

29. A tamper-evident closure comprising:

a container including an upper neck having an open upper end, a circumferential shoulder about said neck having a lower side, a tamper-evident cap having a circumferential parting region at which said cap may be parted into upper and lower cap portions above and below said parting region, closure retaining means engagable with the lower side of said container circumferential shoulder to prevent upward removal of the sealing closure from the container, a removable container sealing cap on said container neck, the tamper-evident closure having means on the tamper-evident cap to cooperate with the sealing cap for resisting relative rotation between the caps upon rotation of the tamper-evident cap until the tamper-evident cap is separated at the parting region by engagement of said closure retaining means with said container shoulder to resist upward movement of the sealing cap, and wherein said upper cap portion is configured and adapted for use as a drinking vessel after parting of said cap at said parting region.

30. A tamper-evident closure for a container including an upper neck having an open upper end, a circumferential shoulder about said neck having a lower side, said tamper-evident closure comprising:

a tamper-evident cap having a circumferential parting region at which said cap may be parted into upper and lower cap portions above and below said parting region, closure retaining means engagable with the lower side of said container circumferential shoulder to prevent upward removal of the sealing closure from the container, the tamper-evident closure having means on the tamper-evident cap to cooperate with the sealing cap for rotation of the sealing cap with the tamper-evident cap upon rotation of the tamper-evident cap until the tamper-evident cap is separated at the parting region by engagement of said closure retaining means with said container shoulder to resist upward movement of the sealing cap, and wherein said upper cap portion is configured and adapted for use as a drinking vessel after parting of said cap at said parting region.

31. A tamper-evident closure for a container having an upper neck with an open upper end, a circumferential shoulder about the neck below the upper end having a lower side, the tamper-evident closure comprising:

a sealing cap engaging the container neck, a tamper-evident cap including a circumferential side wall having a circumferential parting region at which the cap may be parted into upper and lower cap portions above and below said parting region, said lower cap portion containing windows spaced circumferentially about said lower cap portion and each window having a lower end, and said lower cap portion includes resilient prongs joined to said lower cap portion along the lower ends of said windows, respectively and resiliently biased to normal positions in which the prongs extend inwardly and upwardly from said lower cap portion, said prongs having inner ends engagable with the lower side of said container shoulder to prevent upward removal of said cap from said container neck, and said prongs are resiliently flexible upwardly and outwardly from their normal positions into their respective windows to permit downward passage of the prongs over said container shoulder during placement of said cap on the container neck, and wherein the tamper-evident closure has means on the tamper-evident cap to cooperate with the sealing cap for resisting relative rotation between the caps upon rotation of the tamper-evident cap until the tamper-evident cap is separated at the parting region by engagement of said closure retaining means with said container shoulder to resist upward movement of the sealing cap.

32. A tamper-evident closure for a container including an upper neck having an open upper end, and a circumferential shoulder about said neck below said upper end having a lower side, said closure comprising:

a sealing cap engaging the container neck, a tamper-evident cap including a circumferential side wall having a circumferential parting region at which the cap may be parted into upper and lower cap portions above and below said parting region, said lower cap portion containing windows spaced circumferentially about said lower cap portion and each window having a lower end, and said lower cap portion includes resilient prongs joined to said lower cap portion along the lower ends of said windows, respectively and resiliently biased to normal positions in which the prongs extend inwardly and upwardly from said lower cap portion, said prongs having inner ends engagable with the lower side of said container shoulder to prevent upward removal of said cap from said container neck, and said prongs are resiliently flexible upwardly and outwardly from their normal positions into their respective windows to permit downward passage of the prongs over said container shoulder during placement of said cap on the container neck, and wherein the tamper-evident closure has means on the tamper-evident cap to cooperate with the sealing cap for rotation of the sealing cap with the tamper-evident cap upon rotation of the tamper-evident cap until the tamper-evident cap is separated at the parting region by engagement of said closure retaining means with said container shoulder to resist upward movement of the sealing cap.

33. A tamper-evident closure for a container having an upper neck with an open upper end, a circumferential shoulder about the neck below the upper end having a lower side, the tamper-evident closure comprising:

closure retaining means engagable with said container shoulder for resisting removal of said tamper-evident closure from the container, a container sealing cap secured to and closing the upper end of said neck, a tamper-evident cap having a circumferential parting region at which the tamper-evident cap may be parted into an upper cap portion and a lower cap portion, and wherein the tamper-evident closure has means on the tamper-evident cap to cooperate with the sealing cap for resisting relative rotation between the caps upon rotation of the tamper-evident cap until the tamper-evident cap is separated at the parting region by engagement of said closure retaining means with said container shoulder to resist upward movement of the sealing cap.

34. A tamper-evident closure according to claim 33, wherein:

said tamper-evident closure is assembled on the container by urging the tamper-evident closure downwardly over said sealing cap on the container neck and into a position wherein said closure retaining means engages below said container shoulder.

35. A tamper-evident closure for a container having an upper neck having an open upper end, a circumferential shoulder about said neck having a lower side, said tamper-evident closure comprising:

closure retaining means engagable with said container shoulder for resisting removal of said tamper-evident closure from the container, a container sealing cap secured to and closing the upper end of said neck, a tamper-evident cap having a circumferential parting region at which the tamper-evident cap may be parted into an upper cap portion and a lower cap portion, and wherein the tamper-evident closure has means on the tamper-evident cap to cooperate with the sealing cap for rotation of the sealing cap with the tamper-evident cap upon rotation of the tamper-evident cap until the tamper-evident cap is separated at the parting region by engagement of said closure retaining means with said container shoulder to resist upward movement of the sealing cap.

36. A tamper-evident closure for a container having an upper neck with an open upper end, and means extending from said upper neck to define a lower surface, said tamper-evident closure comprising:

a removable sealing cap to close said upper end of said container neck, a tamper-evident cap having a portion thereof disposed above the sealing cap, said cap having a circumferential parting region at which said tamper-evident cap is separable into upper and lower cap portions above and below said parting region, separable interengaging means between said sealing cap and said tamper-evident cap to resist relative rotation therebetween prior to parting of said tamper-evident cap at said parting region and removal of said upper portion of the tamper-evident cap from said sealing cap, and means on the tamper-evident closure to engage said lower surface extending from the upper neck to resist removal of the tamper-evident cap from the sealing cap, whereby the tamper-evident cap is separable into its said upper and lower portions by manual rotation of said upper portion.

37. A tamper-evident closure according to claims 36, wherein:

said tamper-evident closure is assembled on the container by urging the tamper-evident closure downwardly over said sealing cap on said container neck and into a position wherein said means on the tamper-evident closure engage under said lower surface.

38. A tamper-evident closure according to claim 36, wherein:

said separable interengaging means comprise serrations on the tamper-evident cap to resist relative rotation between the caps upon twisting of the tamper-evident cap for separation of the tamper-evident cap upper and lower portions at said parting region.

39. A tamper-evident closure according to claim 36, wherein:

said means extending from the upper neck to define a lower surface comprises an external screw thread extending about said upper neck of the container, and said sealing cap is internally threaded to engage said screw threads.

40. A tamper-evident closure according to claim 36, wherein:

said tamper-evident cap extends below the lower end of the sealing cap, and said means on the tamper-evident closure to resist removal of the tamper-evident cap from the sealing cap, are disposed at the lower end of said tamper-evident cap.

41. A tamper-evident closure according to claim 36, wherein:

said means on the tamper-evident closure to engage said lower surface comprise prongs on the tamper-evident cap which during assembly of the tamper-evident closure on the container engage said means extending from the upper neck and are deflected outwardly to permit the prongs to pass said means extending from the upper neck, and then spring inwardly below the means extending from the upper neck to prevent upward movement of the tamper-evident closure from said means extending from the upper neck.

42. A tamper-evident closure according to claim 41, wherein:

in assembling the tamper-evident closure on the container said prongs are engageable with said container shoulder and are resilient for passage over the said container shoulder and then engaging a lower surface of the shoulder.

* * * * *

UNITED STATES PATENT AND TRADEMARK OFFICE

Certificate

Patent No. 5,711,443 Patented: January 27, 1998

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Paul H. Bennett, San Dimas, CA; and Thom M. Perlmutter, Venice, CA.

Signed and Sealed this Twenty-Eighth Day of December, 1999.

ALLAN N. SHOAP
*Supervisory Patent Examiner*
Art Unit 3727